United States Patent [19]

Ely

[11] 4,216,987

[45] Aug. 12, 1980

[54] SAFETY SHACKLE

[76] Inventor: Robert G. Ely, 2706 W. Ashlan, No. 11, Fresno, Calif. 93705

[21] Appl. No.: 955,127

[22] Filed: Oct. 26, 1978

[51] Int. Cl.[2] ..... B66C 1/34

[52] U.S. Cl. ..... 294/83 R; 24/241 SL

[58] Field of Search ..... 294/75, 82 R, 83 R, 294/83 A, 83 AB, 83 AE, 84; 24/230 TC, 230 AL, 238, 239, 241 SL; 59/85, 86, 93

[56] References Cited

U.S. PATENT DOCUMENTS

| | | | |
|---|---|---|---|
| 1,523,200 | 1/1925 | Holt | 294/83 A |
| 3,066,970 | 12/1962 | Haake | 294/83 A |
| 3,462,945 | 8/1969 | Barber | 59/86 |
| 3,895,836 | 7/1975 | Barnes | 294/83 R |
| 3,929,231 | 12/1975 | Cook | 294/83 R X |
| 3,964,777 | 6/1976 | Lindqvist | 294/83 R |

FOREIGN PATENT DOCUMENTS

| | | | |
|---|---|---|---|
| 903828 | 8/1962 | United Kingdom | 294/82 R |

*Primary Examiner*—Johnny D. Cherry
*Attorney, Agent, or Firm*—Huebner & Worrel

[57] ABSTRACT

A safety shackle including a clevis having a pair of spaced ends defining a throat therebetween, an elongated pin slidably mounted on one of the ends for movement toward the other of the ends into a closed position and from the other end into a released position, a ratchet jack having an oscillating lever and mounted on one end of the clevis for drawing the pin from the closed position into the released position by a plurality of oscillations of the lever, and an elongated flexible member extending from the lever to a position remote from the clevis for remote actuation.

11 Claims, 8 Drawing Figures

SAFETY SHACKLE

BACKGROUND OF THE INVENTION

1. Field of the Invention:

The present invention relates to a safety shackle, and more particularly to such a shackle for use in hoisting a structural element of buildings or the like which is installed in an elevated position, the shackle positively engaging the element until released therefrom by repeated oscillatory movements of a ratchet mechanism from a position remote from the location at which the element is engaged by the shackle.

2. Description of the Prior Art:

In constructing buildings and the like it is frequently necessary to raise a structural element of the building to a location wherein the element is rested in its installed disposition. Normally, the element has a bore extending through it and it is connected to a hoisting cable provided with a clevis by a pin extended through said bore and through bores in the clevis aligned therewith. Before hoisting, a rope or the like is connected to the pin outwardly of the clevis for drawing the pin from the bores to release the clevis from the structural element when the element is rested in said disposition. For a number of reasons, this conventional method of hoisting and releasing such elements is extremely dangerous at worst and highly inconvenient at best.

This method is dangerous because the pin is only retained in the bores by friction due to weight of the element being hoisted subjecting the pin to shear stress. Therefore, the pin can easily become displaced allowing the element to fall and injure persons and/or property below. A primary cause of such displacement is snagging of the rope. The rope is easily snagged since it necessarily dangles from the element during hoisting so that the rope can be grasped to withdraw the pin from the bores when the element is emplaced. If the rope becomes snagged at any point during hoisting, continued hoisting draws the pin from the bores and disengages the element from the hoisting cable.

This danger is greatly increased by the necessity for the rope being substantially longer than the vertical distance between the pin and the ground surface when the structural element is emplaced. Since the pin extends horizontally, the rope must extend in angled relation from the pin to obtain enough purchase to withdraw the pin despite friction between it and the bores. This excess length of the rope, of course, increases the danger of snagging. To reduce this danger, the element must first be hoisted vertically a distance such that the rope clears all portions of a building being constructed, then swung horizontally, and finally lowered to its installed elevation. This excess hoisting not only wastes time, but requires the use of a crane having a longer boom than would otherwise be necessary. The risk of tipping the crane over during hoisting is, of course, increased by the use of a longer boom than would otherwise be required.

When, as intended, the pin does not become dislodged before the element is emplaced, it is often extremely difficult to remove the pin and release the hoisting cable for further use. This difficulty can arise because the rope is kept short to avoid the previously described snagging and hoisting difficulties and because of friction between the pin and the walls of the bores. In many cases the pin cannot be withdrawn even by jerking the rope. In such an event, it is necessary for a person to ascend the partially completed structure to a precarious position to drive the pin out with the attendant danger of falling while ascending and driving the pin.

PRIOR ART STATEMENT

In compliance with the provisions of 37 C.F.R. 1.97 and 1.98, the Applicant is not aware of any prior art which is, in his opinion, relevant to the patentability of the subject invention.

SUMMARY OF THE INVENTION

Accordingly, it is an object of the present invention to provide an improved safety shackle.

Another object is to provide such a shackle which is particularly useful in installing structural elements of buildings and the like.

Another object is to provide such a shackle which will not accidently release an object being hoisted.

Another object is to provide such a shackle which cannot be released inadvertently from an object being hoisted.

Another object is to provide such a shackle which is convenient to release from an object being hoisted when it is desired to do so.

Another object is to provide such a shackle which permits the use of a crane having a shorter boom than normally required.

Still another object is to provide such a shackle which provides increased safety for persons and property in the vicinity of objects being hoisted.

A further object is to provide such a shackle which is durable, economical, rugged, and fully effective in performing its intended function.

DESCRIPTION OF THE PREFERRED EMBODIMENT

Figure 1:
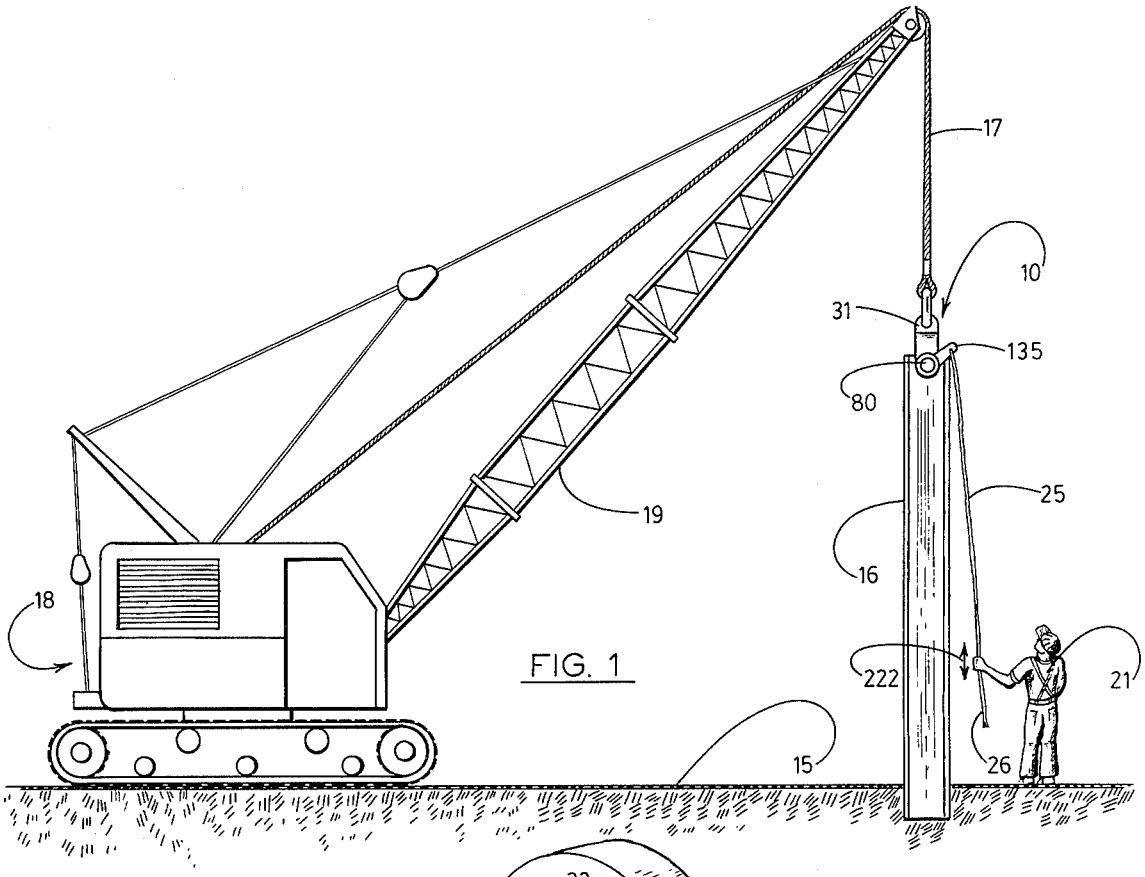
FIG. 1 is an elevation of a safety shackle embodying the principles of the present invention in a representative operating environment.

Referring with greater particularity to the drawings, in FIG. 1 is shown a safety shackle 10 disposed in a representative operating environment. The environment includes an earth surface 15 which supports a column 16 of a building or the like under construction. The upper end of the column is engaged by the shackle in a manner subsequently to be described, and the shackle is connected to a hoisting cable 17 of a diagrammatically represented crane 18 having a boom 19. A workman 21 is depicted standing on the earth surface adjacent to the lower end of the column in a position remote from said upper end.

Figure 2:
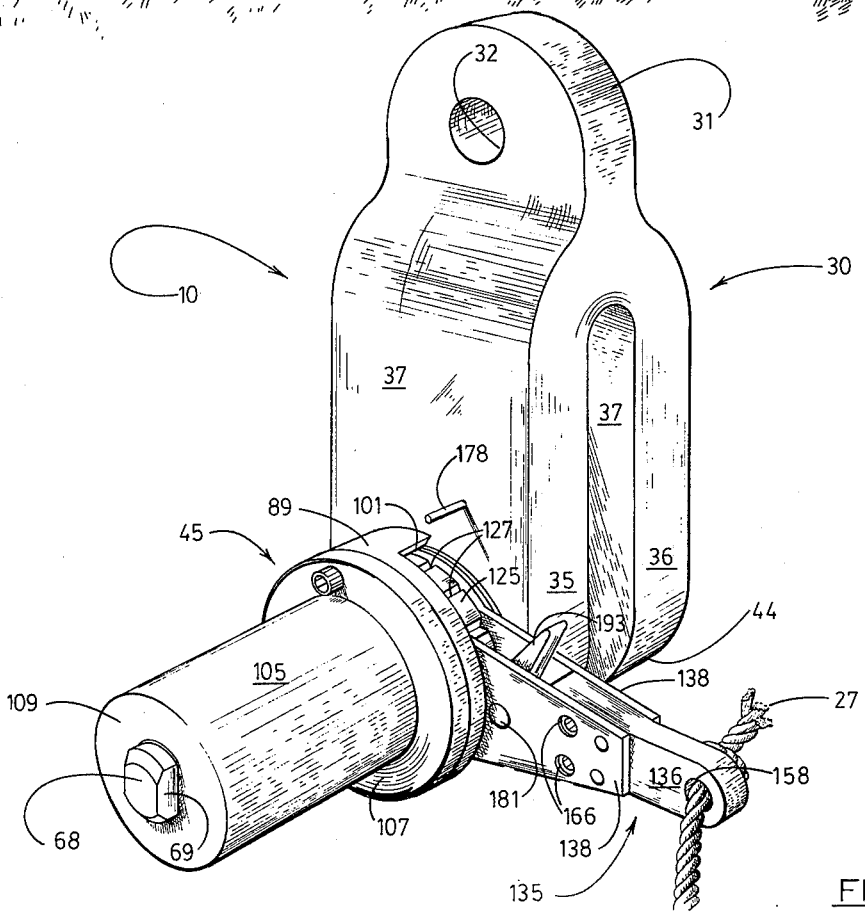
FIG. 2 is a perspective view of the shackle of FIG. 1 with a rope utilized therewith fragmentarily represented.

As shown in FIGS. 1 and 2, the shackle has an elongated flexible tension member or rope 25 having a lower end 26 disposed toward the lower end of the column in a position relatively remote from the balance of the shackle. The rope has a knotted end 27 opposite its lower end and connected, as shown in FIG. 2, to another element of the shackle, subsequently to be described. The workman 21 is depicted grasping the rope near its lower end to actuate the shackle from said remote position.

Figure 4:
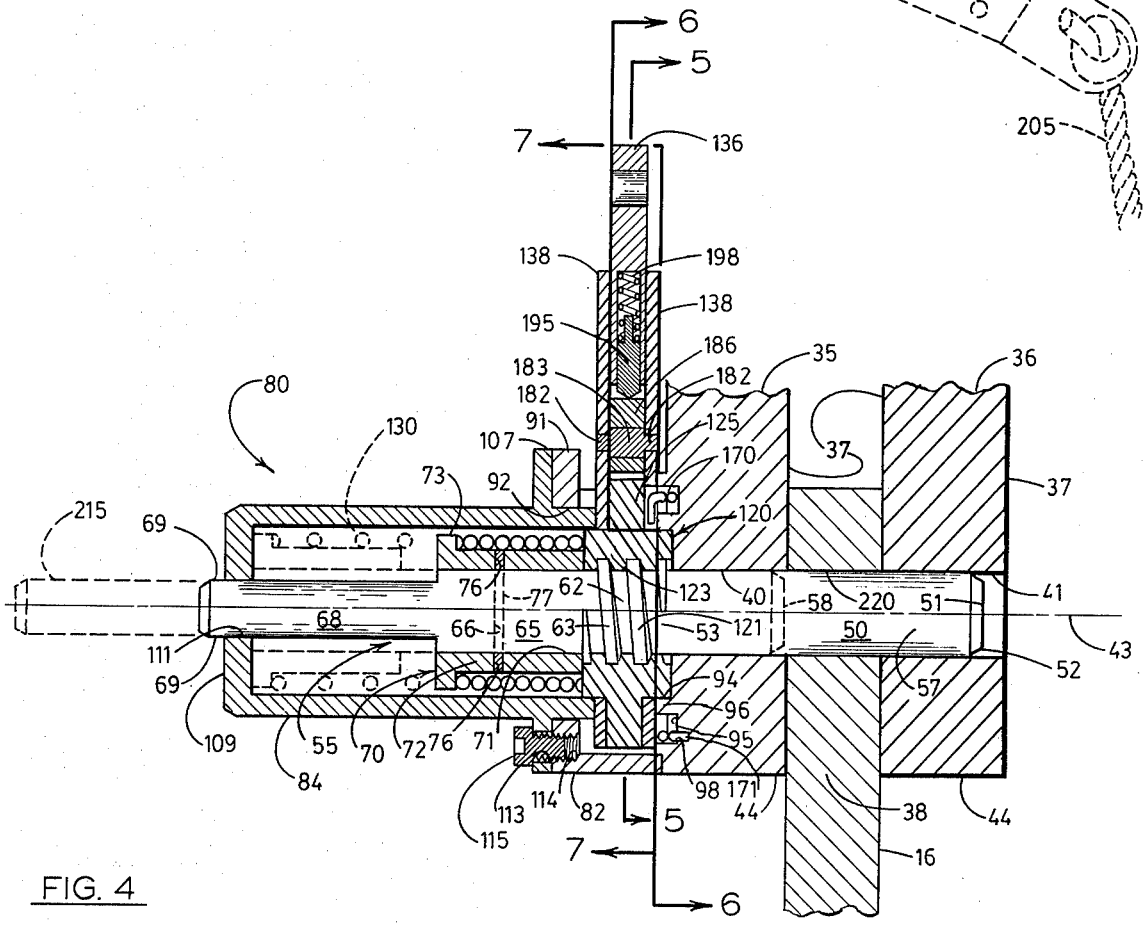
FIG. 4 is a fragmentary section of the shackle taken on line 4—4 of FIG. 3. An alternate position of a pin and related elements is indicated in dashed lines and a fragmentarily represented structural member is shown connected to the shackle.

The shackle 10 has a clevis indicated generally by the numeral 30 and best shown in FIGS. 2 and 4. The clevis is of bifurcated "tuning fork" shape. The clevis has a stem 31 provided with a cylindrical opening 32 for attachment of the shackle to the cable 17. The clevis has a pair of generally planar arms or ends 35 and 36 extending in parallel spaced relation from the stem. These ends have substantially the same thickness and each has a pair of opposite parallel surfaces 37. A throat 38 is defined between the portions of said ends remote from the stem. Said ends 35 and 36 have individual, cylindrical, aligned bores indicated, respectively, by the numerals 40 and 41. These bores are substantially equal in diameter and extend entirely through said ends aligned along an axis 43. Said ends have individual, semicylindrical surfaces 44 disposed oppositely of the stem and concentrically with said bores. The diameter of these surfaces is substantially equal to the width of the ends measured at right angles to said axis and to the stem.

Figure 3:
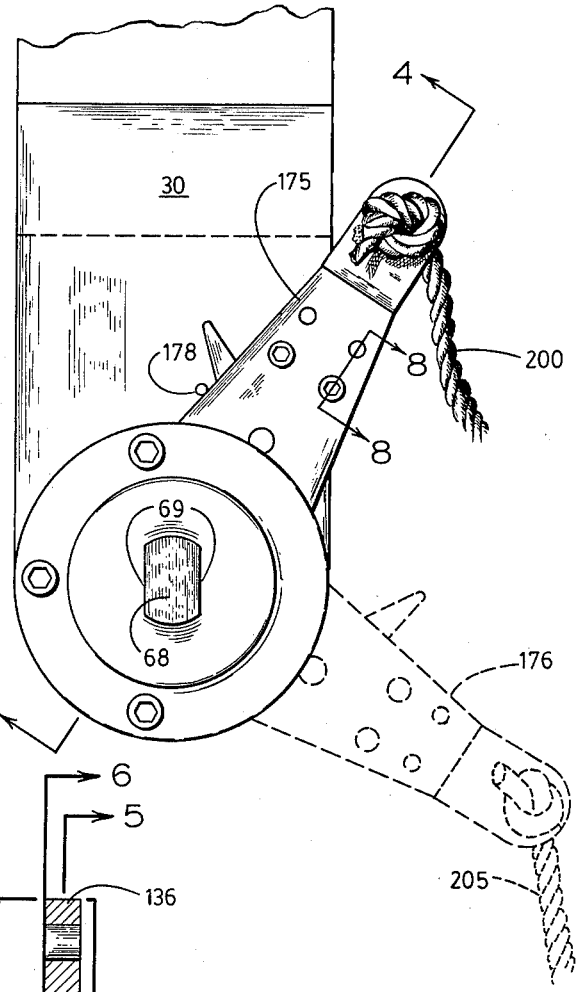
FIG. 3 is a fragmentary side elevation of the shackle at a scale slightly enlarged from FIG. 2 with an alternate position of the rope and a lever indicated in dashed lines.

The shackle 10 has a ratchet jack, indicated generally by the numeral 45 and best shown in FIGS. 2, 3, and 4. The jack includes an elongated, generally cylindrical member 47 mounted on one end 35 of the clevis 30. The axis of the cylindrical member is substantially coincident with the axis 43 and this member has a pair of axially opposite portions. One of these portions forms an elongated cylindrical pin 50 slidably fitted to the bore 40 for axial movement therein and extended therein through said one end of the clevis. This pin has an axial end 51 disposed toward the opposite end 36 of the clevis and is provided with a peripheral bevel 52. The pin has an axial end 53 disposed oppositely of the beveled end and centrally of said cylindrical member.

The axial end portion of the cylindrical member 47 opposite the pin 50 forms a ram 55 of the jack 45. The ram is, in effect, mounted on the end 53 of the pin and is thus slidably mounted on said one end 35 of the clevis for movement along the axis 43 toward and from said opposite end 36 of the clevis. The cylindrical member, which is formed by the pin and the ram, has a pair of extreme axial positions. In one of these positions, indicated by solid lines in FIG. 4, the member is disposed toward said opposite end and the pin engages said opposite end and extends substantially into the bore 41, defining an operable or closed position 57 in relation to the throat 38. In the other of said positions, shown by dashed lines in FIG. 4, the member is disposed away from said opposite end of the clevis so that the beveled end 51 of the pin is retracted within the bore 40 defining a released position 58 of the member in relation to said throat. The pin and the ram subsequently will be described in greater detail together with the balance of the jack.

The ram 55 includes an externally screw threaded portion 62 adjacent to the pin 50. The axial length of this portion is substantially greater than one half the length of the bores 40 and 41. This portion is provided with relatively coarse, double, square, right-hand screw threads 63. The external diameter of these threads is substantially greater than that of said pin. The ram includes a central cylindrical portion 65 having a diameter substantially equal to that of said pin. The central portion is provided with a bore 66 extending through it diametrically adjacent to its axial midpoint. The ram includes a guide portion 68 which extends from said cylindrical portion to the end of the ram oppositely disposed from the clevis 30. The guide portion has an elongated, generally cylindrical form and is substantially equal in diameter to said cylindrical portion. The guide portion is provided with a pair of diametrically opposite, axially extended flat surfaces 69. The length of the guide portion is substantially greater than the distance, measured along the axis 43, between the one of the surfaces 37 of said one end 35 disposed toward the throat 38 and the surface of said other end 36 disposed away from the throat.

The ram 55 has a collar 70 mounted in circumscribing relation on the cylindrical portion 65. The axial length of the collar is substantially equal to that of said portion. The collar has a central bore 71 extended therethrough and fitted to said portion. The collar includes a cylindrical tube 72 axially engaging the screw threaded portion 62 of the ram. The collar includes a circular flange 73 disposed in circumscribing relation about the end of this tube opposite said portion. The tube is provided with a pair of aligned bores 76 extending diametrically through each of its opposite sides. These bores have substantially the same diameter as the bore 66 and are aligned therewith. A pin 77 extends through these bores and fixes the collar to the balance of the ram for axial movement therewith.

The jack 45 is provided with a generally cylindrical housing 80, best shown in FIGS. 2 through 5, mounted on the one end 35 of the clevis 30. The housing is mounted on the one of the surfaces 37 of said end opposite the throat 38. The axis of the housing, is substantially coincident with the axis 43. To facilitate assembly and disassembly of the shackle 10, the housing is axially separable, as best shown in FIG. 4. The housing thus has a drum portion 82 which is, in effect, unitarily constructed with the clevis and a cup portion 84 which is detachably mounted on the drum portion oppositely from the clevis.

The drum portion 82 is best shown in FIGS. 2, 4, 5 and 6, and includes a cylindrical tube 89 disposed coaxially with the bores 40 and 41. The radius of this tube is substantially equal to the radius of the surfaces 44 of the ends 35 and 36 of the clevis 30. The axial end of the tube disposed oppositely from the clevis is closed by a disk 91 unitarily constructed with the tube. The disk has substantially the same external diameter as the tube. The disk is provided with a bore 92 extending concentrically therethrough having a diameter substantially greater than the diameter of the flange 73 of the collar 70. The tube is welded to the end 35 of the clevis oppositely of the throat 38 so that the corresponding surface 37 of said end closes the corresponding axial end of the drum portion. Said surface is provided with a counterbore 94 circumscribing the bore 40. The diameter of the counterbore is somewhat larger in diameter than said flange of the collar 70, but it is smaller in diameter than the bore 92. A circular groove 95 is formed in said surface in circumscribing relation to the counterbore. A circular land 96 is thus defined between the bore and the groove. A relatively small bore 98 extends parallel to the axis 43 and into said end of the clevis. This bore is disposed oppositely of said axis from the stem 31 toward the periphery of the groove.

Figure 5:
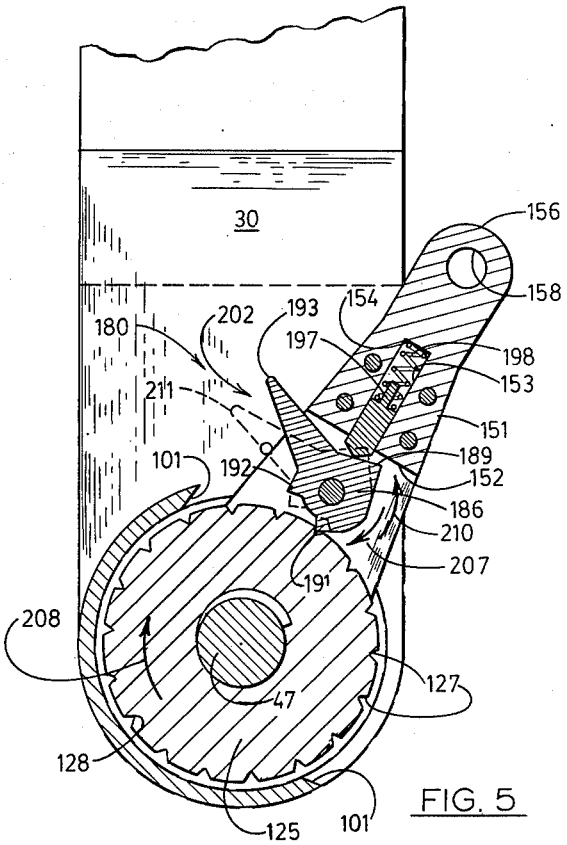
FIG. 5 is a fragmentary section of the shackle taken on line 5—5 of FIG. 4 with an alternate position of a pawl utilized with the shackle shown in dashed lines.

The tube 89 is provided with a circumferential slot 100 disposed adjacent to the end 35 of the clevis 30. As best shown in FIG. 5, the width of the slot is somewhat greater than one half of the circumference of the tube. The center of the slot is disposed substantially along a line extending at a right angle to the stem 31 and to the axis 43. The slot has opposite ends 101. In relation to the axis 43, one of these ends is disposed toward the stem 31 of the clevis and the other end is disposed oppositely of the stem. These ends of the slot are beveled so that the slot has a somewhat greater length circumferentially of the tube at its interior than at its exterior thereof.

The cup portion 84 of the housing 80 has a cylindrically tubular body 105, best shown in FIGS. 2, 3 and 4. The body is disposed concentrically with the pin 50 and is extended axially from the end 35 of the clevis 30. The body extends axially from a point approximately at the axial midpoint of the tube 89 to a point spaced from said end a distance which is somewhat less than the axial length of the ram 55. The internal diameter of the body is substantially equal to the diameter of the counterbore 94. The external diameter of the body is such that it is slidably fitted to the bore 92 in the disk 91 of the drum portion 82. The cup portion includes a planar flange 107 extending circumferentially about said body. The flange is disposed on the body in axially adjacent relation to one of its axial ends. The opposite axial end of the body is closed by a disk 109. This disk is provided with a central opening 111 conforming and slidably fitted to the guide portion 68 of the ram.

When the cup portion 84 is mounted on the drum portion 82, the axial end portion of the tubular body 105 disposed oppositely of the disk 109 extends through the bore 92 and the flange 107 axially engages the disk 91. The axial end of the body opposite said disk is thus disposed in facing, spaced relation to the land 96 in the end 35 of the clevis 30, and the guide portion 68 of the ram 55 is extended through the opening 111 in the disk. Said flange is provided with three circumferentially spaced bores 113 extending through it parallel to the axis 43. The disk 91 of the drum portion is provided with three screw threaded bores 114 aligned individually with these bores in the flange. The cup and drum portions are secured in their assembled relation by three screws 115 individually extending through the bores in the flange and screw threadably engaging the bores in the drum portion.

The jack 45 has a nut 120, best shown in FIGS. 2, 4 and 5, of unitary construction. The nut is provided with internal screw threads 121 mating with the screw threads 63 of the ram 55. The nut has a central tube 123 whose axial length is substantially equal to the length of the screw threaded portion 62 of the ram. Said internal screw threads are formed in and extend throughout the interior of the tube. The exterior diameter of the tube is such that the tube is rotationally fitted within the counterbore 94 and within the body 105 of the cup portion 84. The nut is thus disposed within the housing 80 for rotation about the axis 43. The nut includes a disk-like ratchet wheel 125 circumscribing said tube at its axial midpoint. The thickness of the wheel is approximately one third of the length of said tube so that the tube extends axially from the wheel an equal distance on both sides thereof. The diameter of the wheel is somewhat less than the interior diameter of the tube 89 of the drum portion 82. The periphery of the wheel is provided with a plurality of substantially identical notches 127, best shown in FIGS. 2 and 4, which are equally spaced circumferentially about the wheel. The notches are of right equilateral triangular configuration and have their vertexes disposed toward the center of the wheel.

As shown in FIG. 4, the nut 120 is disposed within the housing 80 with one end of the tube 123 fitted into the counterbore 94 and with the opposite end of the tube fitted into the body 105 of the cup portion 84. The axial thickness of the nut is substantially less than the axial distance between the end of said body facing the land 96 and said land. The opposite sides of the wheel are disposed in spaced relation, respectively, to the body and to the land.

The shackle 10 includes a helical compression spring 130 extending coaxially with the ram 55. The interior and exterior diameter of the spring are such that it is loosely fitted between the tubular portion 72 of the collar and the body 105 of the housing 80. The spring has opposite axial ends individually engaging the flange 73 of the collar 70 and the axial end of the tube 123 disposed toward said flange. The spring is thus disposed so that it resiliently urges the ram 55 away from the clevis 30. Since the pin 50 is unitarily constructed with the ram, the spring resiliently urges the pin from its closed position toward its released position.

Figure 6:
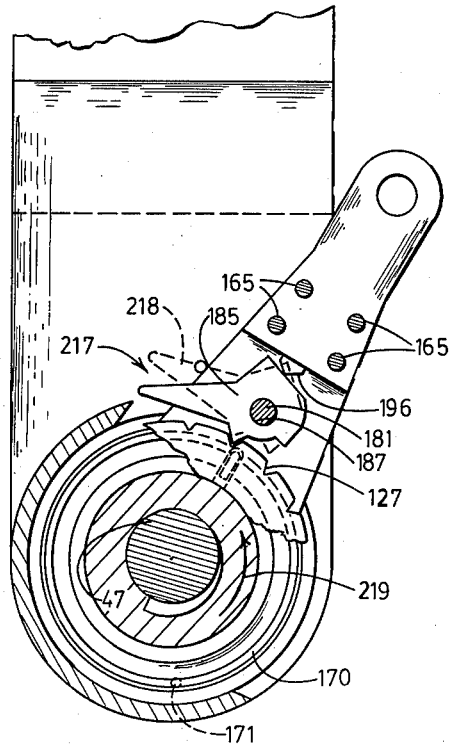
FIG. 6 is a fragmentary section taken on line 6—6 of FIG. 4 with an alternate position of the pawl shown in dashed lines.

The jack 45 includes an actuating or oscillating lever 135, best shown in FIGS. 2, 3 and 6. The lever is formed by a planar spacer 136 "sandwiched" between a pair of side plates 138. Each side plate, as best shown in FIG. 6, has an annular ring 140 which defines a circular central opening 141 therein. The exterior diameter of the ring is substantially equal to the exterior diameter of the ratchet wheel 125, and the opening is rotationally fitted to the tube 123 of the nut. Each plate has an extension 142 extending generally radially from the ring. Each extension has a generally trapezoidal form having a small base end 144 disposed away from the ring. Each extension is provided with a bore 146 extending through it adjacent to the ring and substantially parallel to the central opening therein. The axis of the bore is disposed so as to intersect a radius of the ring extending substantially centrally of the extension. The side plates are substantially identical except that the ring of one of the plates has a notch 148 extending radially from its central opening toward the bore 146 in its extension.

The spacer 136 has a trapezoidal end portion 151 substantially conforming to the portions of the extensions 142 toward their smaller ends 144 and disposed between said portions. This portion of the spacer has a side 152 disposed toward the rings 140 and extending substantially normally to a radius thereof. The spacer is provided with a bore 153 whose axis substantially coincides with a radius of the ring extending through the axes of the bores 146 in the extensions. The bore in the spacer extends inwardly of the spacer from said side to a closed end 154 disposed between the smaller ends 144 of the extensions. The spacer has an end portion 156 opposite its trapezoidal end portion. This portion projects a substantial distance outwardly from between the extensions and radially of the rings. This portion is provided with a circular eye 158 extending through it parallel to the openings 141 in the rings and remotely therefrom.

Figure 8:
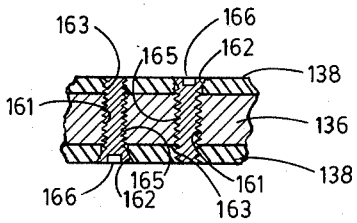
FIG. 8 is a fragmentary section at an enlarged scale taken on line 8—8 of FIG. 3.
Figure 7:
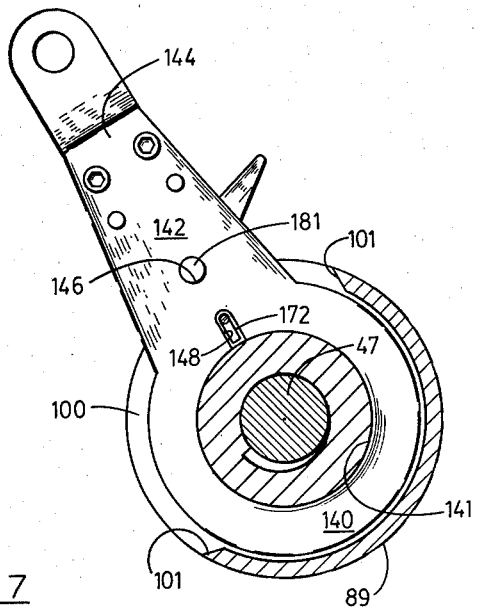
FIG. 7 is a fragmentary section of the shackle taken on line 7—7 of FIG. 4 showing the lever.

As best shown in FIGS. 2, 7 and 8, the spacer 136 is provided with four screw threaded bores 161 extended entirely through its trapezoidal portion 151 and parallel to the openings 141 in the rings 140. A pair of said bores are disposed on each side of the bore 153 in the spacer. Each of the plates 138 is provided with a pair of countersunk bores 162 and a pair of screw threaded bores 163. These bores are individually aligned with one of said bores in the spacer. The countersunk bores in each plate are disposed axially oppositely of the screw threaded bores in the other plate. The spacer and the plates are held in assembled relation to form the lever 135 by four screws 165 each having a conical head 166 fitted to one of the countersunk bores. Each screw extends from its respective countersunk bore in one of the plates in the screw threaded engagement with the corresponding bores in the spacer and the other of the plates.

The lever 135 is mounted on the housing 80 and on the nut 120 as best shown in FIGS. 2, 4, and 5. The plates 138 are disposed in parallel relation on the opposite sides of the ratchet wheel 125. The facing surfaces of the plates are engaged with the wheel and the rings 140 are fitted in circumscribing relation to the central tube 123. The thickness of the spacer is slightly greater than the thickness of the ratchet wheel so that the lever is free to pivot about the nut. The spacer having the notch 148 is disposed toward the land 96. The spacer and the extensions 142 extend radially from the axis 43 through the circumferential slot 100 in the drum portion 82. The combined thickness of the spacer and the plates is slightly less than the axial distance between the land 96 and the tubular body 105 so that the lever is guided therebetween for oscillating movement about the axis 43.

The jack 45 has a helical ratchet spring 170, shown in FIGS. 4, 6 and 7, disposed in the circular groove 95 in the end 35 of the clevis 30. One end 171 of the spring is bent so as to extend parallel to its axis and is axially received in the bore 98 in the clevis. The opposite end 172 of the spring is bent so as to extend axially thereof approximately one half of the thickness of the side plate 138 having the notch 148 and then bent so as to extend radially inwardly of the spring. This opposite end is received in the notch. The opposite ends of the spring thus engage the lever 135 and the clevis 30. The spring is wound so as to urge the lever rotationally in a direction, counterclockwise as shown in FIG. 3, toward a first portion 175, indicated in solid lines, from a second position 176 indicated in dashed lines. The knotted end 27 of the rope 25 extends through the eye 158. This end is disposed so as to engage the lever and draw it toward the second position against the urging of said spring.

As best shown in FIG. 5, movement of the lever 135 beyond its second position 176 is prevented by engagement of the lever with the one of the ends 101 of the slot 100 disposed oppositely of the axis 43 from the stem 31. Movement of the lever beyond its first position 175 is prevented by engagement of the lever with a cylindrical stop pin 178, best shown in FIGS. 2, 3 and 5. The pin is mounted on the side 35 of the clevis 30 on the one of the surfaces 37 on which the housing 80 is mounted. The pin extends substantially parallel to said axis and is disposed radially therefrom so as to engage the lever adjacent to the screws 165. The pin is disposed so as to engage the lever at a point in its pivotal movement away from its second position just prior to the point at which the pawl 185 would engage the one of the ends of the slot disposed toward said stem.

The jack 45 has a pawl assembly, indicated generally by the numeral 180 and best shown in FIGS. 4 and 5, mounted on the lever 135 for oscillation therewith about the axis 43. The assembly includes a cylindrical pivot 181. The pivot has a pair of axially opposite end portions 182 individually fitted within the bores 146 in the side plates 138. The pivot has a central portion 183 somewhat larger in diameter than said end portions and extending therebetween. The axial length of the central portion is substantially equal to the thickness of the spacer 136 so that it is clamped between the plates when the screws 165 are installed.

The pawl assembly 180 includes a unitary pawl 185 having a central, roughly circular body 186 provided with a bore 187 pivotally fitted to the central portion 183 of the pivot 181. The pawl has a projection 189 of right equilateral triangular configuration extended radially from the body to an apex disposed toward the bore 153 in the spacer 136. The radial distance from said bore to the apex is somewhat less than the corresponding distance from the pivot to the side 152 of the spacer. The pawl has a releasing tooth 191 and a closing tooth 192 extended radially from the body. These teeth are disposed oppositely of the pivot from said projection and are disposed individually on the opposite sides of a diameter of the body extending through said apex. The teeth have a substantially right equilateral triangular configuration. The apex of each tooth is spaced radially from the pivot a greater distance than the distance that the vertexes 128 of the notches 127 are spaced from the pivot at their points of closest approach thereto. The releasing tooth is disposed on the side of the pivot which is directed toward the second position 176 of the lever 135. The closing tooth is disposed on the opposite side of the pivot toward the first position 175. The pawl has a toggle 193 of elongated equilateral triangular configuration. The toggle extends oppositely of the second position 176 of the lever and radially from said body at a right angle to a radius thereof which passes through the apex of the projection 189. The toggle extends from between the plates 138 to an apex disposed substantially outwardly thereof.

The pawl assembly 180 includes a cylindrical plunger 195 fitted to the bore 153 for axially slidable movement therein. The plunger has a conical axial end 196 disposed toward the projection 189 of the pawl and has an opposite axial end 197. This opposite end is substantially smaller in diameter than the bore and is circumscribed by a helical detent spring 198. The opposite axial ends of this spring individually engage the closed end 154 of said bore and the plunger urging it toward said projection so that said conical end is resiliently engaged with the plunger.

OPERATION

The operation of the described embodiment of the present invention is believed to be clearly apparent and is briefly summarized at this point. The operation of the elements of the shackle 10 will be described first and then the manner of using the shackle in its representative operating environment shown in FIG. 1 will be described.

Initially, it is assumed that the elements of the shackle are disposed in their relative positions shown in solid lines in FIGS. 2, 3, 4 and 5. When so disposed, the pin is in its closed position 57 in which its ends 51 is received within the bore 41. The pin is thus engaged with the end 36 of the clevis 30 and closes the throat 38. The ram 55 is disposed with its screw threaded portion 62 fully engaged by the nut 120. The axial end of the tubular portion 72 of the collar 70 disposed oppositely of the flange 73 is engaged with the nut. The retraction spring 130 is, therefore, fully compressed and urges the ram and the pin along the axis 43 and away from said end of the clevis. The pin is, however, retained in its closed position since the ram, which is connected thereto, is fully screw threadably engaged by the nut. The nut is connected to the clevis through, successively, the side plates 138 of the lever 135 and the housing 80. The opposite ends of the spring bear on the collar and the nut so that the force of the spring is not exerted in the lever 135 of the clevis 30. As a result, movement of the nut or the lever are not impeded where they engage each other or the clevis by friction created by this force. When the pin is in its closed position, the guide portion 68 of the ram extends through the opening 111 in the housing and a relatively short distance outwardly thereof to indicate usually that the pin is in said position.

In said initial relative positions of the elements of the shackle 10, the lever 135 is disposed in its first position 175 shown in solid lines in FIG. 3. Since the rope 25 is slack, as indicated by the numeral 200, the ratchet spring 170 has urged the lever rotationally into said position.

In FIGS. 3, 5 and 7, the pawl 185 is depicted in a releasing position indicated by the numeral 202. In this position, the toggle 193 of the pawl is disposed toward the spacer 136 of the lever 135 so that the releasing tooth 191 of the pawl is engaged with a notch 127 of the ratchet wheel 125. The pawl is urged into this position by the detent spring 198 which urges the plunger 195 into engagement with the projection 189 so as to pivot the pawl about the pivot 181 and into said position. Rotation of the nut 120 due to vibration or the like is prevented by detent action of the tooth in the notch. Since the nut is prevented from rotating, the pin 50 is maintained in its closed position 57.

To move the pin 50 from its closed position 57 toward its released position 58, the rope 25 is tensioned as shown in dashed lines in FIG. 3 and as indicated by the numeral 205. This tensioning draws the lever 135 in a clockwise direction, as shown in FIGS. 3 and 5, so that it pivots about the axis 43 into its second position 176. Since, as previously described, the releasing tooth 191 of the pawl is engaged with a notch 127, the pawl tends to pivot as indicated by the arrow 207 in FIG. 5 wedging the tooth into the notch rotating the nut 120 in the same clockwise direction as the lever as indicated by the arrow 208 in FIG. 5. This rotation of the nut tends to "unscrew" it from the ram 55 in a direction toward the clevis 30. However, the tube 123 of the nut is engaged with the counterbore 94 in the clevis so that the nut cannot move in this direction. As a result, the ram 55 is moved away from the clevis, driving the pin 50 away from the end 36 of the clevis and from its closed position toward its released position.

One movement of the lever 135 from its first position 175 to its second position 176 is insufficient to screw threadably disengage the nut 120 from the ram 55 for two reasons. First, the arc of oscillation of the lever is restricted by the circumferential width of the slot 100 thus limiting the corresponding rotation of the nut. Secondly, the pitch of the mating screw threads 63 and 121, respectively, of the ram and the nut is limited. Said arc and said pitch are predetermined so that a pluralityof movements of the lever from its first position toward its second position are required to screw threadably disengage the ram from the nut. Preferably, six or seven such movements are required for reasons subsequently to be described. The ram is moved a predetermined axial distance away from the clevis 30 by the action of said screw threads during the rotation of the nut corresponding to each of said movements of the lever. The ram drives the pin with it an equal distance defining one increment of stepped progression through which the pin moves away from the end 36 of the clevis from its closed position 57 toward its released position 58.

When the pawl 185 is in its releasing position 202 and the lever 135 is in its second position 176, slackening the rope permits the spring 170 to return the lever to its first position 175. As the lever returns, the nut 120 does not rotate due to ratchet action of the pawl in the well known manner. As shown in FIG. 5, when the lever returns toward its first position, the pawl is urged to pivot in the direction indicated by the arrow 210 into ratcheting position shown in dashed lnes and indicated by the numeral 211. In this position, the releasing tooth 191 does not engage one of the notches 127, and the closing tooth does not engage the ratchet wheel 125. As a result, the nut does not rotate and the relative position of the pin 50 and the ram 55 relative to the clevis 30 does not charge during this return movement of the lever. An oscillation of the lever is defined by each movement thereof in a direction from the first position toward the second position followed by a return movement in the opposite direction. Each oscillation rotationally activates the nut and causes it to motivate the pin through one of the above described increments of stepped progression. Since the pin must be moved through a plurality of such increments before the ram screw threadably disengages the nut, the pin moves axially a substantial distance from its closed position prior to such disengagement. This distance is, of course, substantially equal to the axial length of the screw threaded portion 62 of the ram.

When the lever 135 has oscillated the predetermined number of times required to screw threadably disengage the ram 55 from the nut, the spring 130 urges the ram 55 to move into the position 215 indicated in dashed lines in FIG. 4. The pin 50 is drawn into its released position 58 by this movement of the ram. When the pin is in said position, the guide portion 68 of the ram extends a substantial distance from the housing 80 indicating visually that the pin is in its released position. It should be noted, however, that a relatively large force exerted radially on the pin causes it to engage frictionally the bores 40 and 41 so that said spring can not exert enough force to overcome this frictional engagement. In this event, the pin will not move to its released portion until the radial force is removed or sufficiently decreased.

When the pin 50 is in its released position 58, it is returned to its closed position 57 by, first, pivoting the pawl 185 about the pivot 181 to its closing position 217 indicated in solid lines in FIG. 6. The pawl is moved manually into this position by applying sufficient pressure to the toggle 193 to move the projection 189 "over center" to the opposite side of the plunger 195 from which the projection was disposed in its releasing position 202. Oscillation of the lever 135 about the axis 43 will then rotationally drive the nut 120 in a counterclockwise direction as indicated by the arrow 219 by ratchet action of the pawl assembly 180 and wheel 125 similar to that previously described. Rotation of the nut in said direction drives the ram 55 toward the clevis 30 when the ram is screw threadably engaged by the nut. Since the ram is not so engaged when the pin 50 is in its released position, it is next necessary manually to move the ram into engagement with the nut by pressing the guide portion 68 of the ram toward the housing 80. When the ram and the nut are so engaged, repeated oscillations of the lever will move the ram into its position shown in solid lines in FIG. 4 driving the pin into its closed position 57. When the pin is in this position, the shackle 10 is readied for moving the pin to its released position 58 simply by manually pressing the toggle 193 in a direction to return it to its releasing position 202 shown in FIG. 5. Movement of the toggle between this position and its closing position 217 thus selectively adapts the jack 45 to retain the pin in its closed position or to urge the pin therefrom toward its released position by establishing the direction of oscillation of the lever 135 in which the pawl 185 becomes engaged in driving relation with the ratchet wheel 125.

The safety shackle 10 of the present invention is utilized in its operating environment in a manner best shown in FIGS. 1 through 6. The clevis 30 is securely connected to the hoisting cable 17 in any suitable manner. Structural elements of buildings, typified by the column 16, are provided with bores for use in attaching them to other elements of the building by bolts or rivets. The shackle 10 is first connected in hoisting relation to the column by inserting its pin 50 through a suitable one of these bores indicated in FIG. 4 by the numeral 220.

To connect the shackle 10 to the column 16, the pin 50 is moved to its released position 58 together with associated elements of the shackle by placing the pawl 185 in its releasing position 202 and oscillating the lever 135 as previously described. When the pin is in its released position, the pawl is moved to its closing position 217. The shackle is then positioned with the ends 35 and 36 of the clevis 30 disposed at the opposite ends of the bore 220 and with the bores 40 and 41 aligned therewith. The pin is then extended through said bore by moving the pin to its closed position 57. As previously described, this movement is performed by pressing the guide portion 68 toward the housing and then oscillating the lever until the collar 70 engages the nut 120. The shackle is thereby securely connected to the column 16. The pawl 185 is next moved to its releasing position 202. The crane 18 is utilized to raise the column 16 and move it to its installed disposition. In this disposition the column is, of course, positioned for connection thereto of other elements of a structure. The column is depicted in FIG. 1 as rested in the earth surface 15 which supports the column in its installed disposition. When the shackle 10 is utilized to raise another structural element, this element can be supported, of course, by connection to previously installed elements. In any event, when the column or other structural element is supported in its installed disposition, the shackle is disconnected therefrom by moving the pin to its released position 58 by oscillating the lever 135 by successive pulls on the rope 25.

This movement of the pin 50 to its released position 58 is depicted in FIG. 1 in which a workman 21 is alternately tensioning and slackening the rope 25 as indicated by the arrows 222. When the rope is tensioned, the lever is drawn to its second position 176. When the rope is then slackened, the lever is returned to its first position 175 by the spring 170. As previously mentioned, a multiplicity of oscillations of the lever, six or seven typically, are required to unscrew the ram 55 from the nut 120. If the rope becomes snagged any lesser number of times as the column is hoisted, the column will not become disengaged from the shackle so as to fall and injure persons or property below. As is clearly apparent, such disengagement can only occur when the rope is repeatedly slackened and tensioned to release the shackle from the column when it is finally rested in its installed position. That the pin has moved to its released position 58 is indicated to the workman 21 by the protrusion of the guide portion 68 from the housing 80 and by the sound made by the ram 55 striking the interior of the housing under the urging of the spring 130.

It will be noted that the rope 25 need only be long enough to extend from the lever 135 to the position occupied by the workman 21. This position is substantially vertically below the clevis 30 since this is the position giving the best mechanical advantage for actuating the lever. When the shackle 10 is utilized with a column in the general manner depicted in FIG. 1, the rope can, in face, be shorter than the column 16 so that the length of the boom 19 need not be any longer than required to emplace the column.

It should be noted that, in the unlikely event the pin 50 is moved out of its closed position 57 a distance such that the nut 120 is screw threadably disengaged from the ram 55 while the column 16 is still supported by the cable 17, the shackle will still not become disengaged from the column, allowing it to fall. This is because the friction created between the pin and the bores 40 and 41 by the weight of the column is too great to be overcome by the retraction spring 130. As a result, the pin, although not in its closed position, cannot move to its released position 58. This event could only occur if the ram, through carelessness, were only slightly engaged with the nut and the rope 25 became snagged while the column was being raised, and even then the safety shackle 10 would not allow the column to fall.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A safety shackle comprising

A. a clevis having a pair of spaced ends;

B. a pin slidably mounted on one of said ends for movement toward and away from the other of said ends between a closed position extended between said ends and a position retracted from the other of said ends;

C. a reversible ratchet mounted on said one of said ends having connection to the pin adapted in one mode of operation to move the pin axially from closed position to retracted position and in another mode of operation from retracted position to closed position; and D. means for actuating said ratchet in said one mode of operation from a position remote from the clevis.

2. The shackle of claim 1 wherein

A. the ends of the clevis define a throat therebetween;

B. the pin in closed position extends across the throat into engagement with said other end of the clevis and in retracted position is retracted from said throat;

C. the ratchet comprises a jack having oscillating means for moving the pin from the closed position to the retracted position by a plurality of oscillations of said oscillating means; and D. the oscillating means is connected to the actuating means for oscillatory actuation thereby.

3. A safety shackle comprising

A. a clevis having a pair of spaced ends;

B. a pin slidably mounted on one of said ends for movement toward and from the other of said ends between a closed position extended between said ends and an open position retracted from said other end;

C. resilient means urging the pin toward said open position;

D. means releasably interconnecting the clevis and the pin for selectively retaining the pin is a closed position against the urging of the resilient means; and E. means for releasing said interconnecting means from a position remote from the clevis so that the pin is urged from the closed position by the resilient means, the releasing means including oscillating means mounted on the clevis, an elongated member having an end connected to the oscillating means and extended therefrom to an opposite end disposed at said remote position, and the releasing means being adapted to release the interconnecting means when the oscillated means is repeatedly oscillated from said remote position by the elongated member.

4. A safety shackle comprising

A. a clevis having a pair of spaced ends defining a throat therebetween;

B. an elongated pin having a pair of opposite ends and slidably mounted on one of the ends of the clevis for longitudinal movement toward and from the other of the ends of the clevis between a closed position in which one end of the pin engages said other end of the clevis and a released position in which said one end of the pin is substantially clear of the throat;

C. a ratchet jack mounted on said one end of the clevis including (1) a ram slidably mounted on the clevis and connected to the other of said ends of the pin for movement therewith, (2) means selectively engaging the ram for drawing the pin from the closed position toward the released position in a succession of increments of stepped progression, (3) oscillating means for actuating the ram engaging means so that each oscillation of the oscillating means corresponds to one of said increments, (4) means for selectively returning the pin to the closed position from the released position; and D. an elongated flexible member having an end connected to said oscillating means and an opposite end disposed in a position remote from the clevis for oscillating said oscillating means from said remote position.

5. The shackle of claim 4 wherein

A. the ram is provided with screw threads;

B. the ram engaging means comprise a nut screw threadably engaging said threads when the pin is in the closed position; and C. the oscillating means comprises a pawl engaging the nut on each oscillation of said oscillating means so as rotationally to drive the nut in a direction and for a distance such that the pin is moved through one of said increments of stepped progression on each oscillation of said oscillating means.

6. The shackle of claim 5 wherein

A. the shackle includes resilient means for urging the pin from the closed position toward the released position;

B. the nut becomes screw threadably disengaged from the ram when the pin has moved from said closed position a substantial portion of the distance to said released position; and C. the resilient means resiliently urges the pin into said released position when the nut is disengaged from the ram.

7. The shackle of claim 6 wherein

A. the pin, the screw threads of the ram, and the nut have axes which are coincident; and B. the ram is mounted on said other end of the pin.

8. A safety shackle comprising

A. a bifurcated clevis having a pair of spaced arms defining a throat therebetween, said arms having aligned bores therethrough on opposite sides of the throat;

B. a pin mounted in the bores transversely of the throat for reciprocal axial movement between an operable position with opposite ends thereof disposed in the bores with the pin disposed transversely of the throat and a position retracted from one of the bores and the throat into the opposite bore;

C. a reversible ratchet mounted on the clevis having driving connection to the pin adapted in one mode of operation to move the pin axially in a direction from operable toward retracted position and in another mode of operation to move the pin axially in a direction from retracted toward operable position, said ratchet having an actuating lever oscillated to actuate the ratchet; and D. a flexible tension member connected to the lever for remote actuation thereof by exerting successive pulling action thereon.

9. The safety shackle of claim 8 in which the ratchet in each of the oscillations of its lever moves the pin an increment of stepped progression a fraction of the distance between its operable and retracted positions so that a multiplicity of oscillations is needed to cause the pin to traverse such distance.

10. A safety shackle comprising

A. a clevis having a pair of spaced ends defining a throat therebetween;

B. a pin slidably mounted on one of said ends for movement toward and from the other of said ends between a closed position extended transversely of the throat and a position retracted from said throat;

C. resilient means urging the pin from the closed position to the retracted position;

D. a jack mounted on said one of said ends having oscillating means to drive the jack and connection to the pin adapted in one mode of operation to move the pin axially from closed position to retracted position by a plurality of oscillations of the oscillating means; and E. a flexible tension member connected to the oscillating means for remote actuation thereof by exerting successive pulling action thereon.

11. The shackle of claim 10 wherein the jack includes

A. a member movably mounted on the clevis and connected in driving relation to the pin for movement in opposite directions corresponding to the movement of the pin towards and from said other of the ends of the clevis; and B. means engaging the member for selectively motivating the member so as to move the pin away from said other end of the clevis when the oscillating means is oscillated.

* * * * *

UNITED STATES PATENT AND TRADEMARK OFFICE

CERTIFICATE OF CORRECTION

PATENT NO. : 4,216,987

DATED : August 12, 1980

INVENTOR(S) : Robert G. Ely

It is certified that error appears in the above-identified patent and that said Letters Patent are hereby corrected as shown below:

Column 10, line 29, delete "lnes" and insert ---lines---;

Column 12, line 30, delete "face" and insert ---fact---.

Signed and Sealed this

*Eighteenth* Day of *November 1980*

[SEAL]

*Attest:*

SIDNEY A. DIAMOND

*Attesting Officer*

*Commissioner of Patents and Trademarks*